United States Patent [19]

Freeauf

[11] Patent Number: 4,499,696

[45] **Date of Patent: * Feb. 19, 1985**

[54] DWELLING STRUCTURE

[76] Inventor: Robert F. Freeauf, 4487 Mt. Troy Road Extension, Pittsburgh, Pa. 15214

[ * ] Notice: The portion of the term of this patent subsequent to Feb. 17, 1998 has been disclaimed.

[21] Appl. No.: 232,995

[22] Filed: Feb. 9, 1981

Related U.S. Application Data

[63] Continuation-in-part of Ser. No. 944,788, Sep. 22, 1978, Pat. No. 4,250,669.

[51] Int. Cl.[3] ..... E04H 1/12

[52] U.S. Cl. ..... 52/79.8; 52/143; 414/401

[58] Field of Search ..... 52/79.1, 79.7, 79.8, 52/79.9, 79.12, 745, 143

[56] References Cited

U.S. PATENT DOCUMENTS

| | | | |
|---|---|---|---|
| 2,247,340 | 6/1941 | Webster | 52/79.8 |
| 2,840,866 | 7/1958 | Paulsen | 52/79.8 |
| 2,841,832 | 7/1958 | Couse | 52/79.8 |
| 3,388,512 | 6/1968 | Newman | 52/79.12 |
| 3,525,186 | 8/1970 | Lombardo | 52/79.12 |
| 3,604,166 | 9/1971 | Ciccarelli | 52/745 |
| 3,666,118 | 5/1972 | Raynes | 414/401 |
| 3,679,177 | 7/1972 | Scholz | 52/79.1 |
| 3,690,077 | 9/1972 | Dalgliesh | 52/584 |
| 4,102,273 | 7/1978 | Merkle | 414/401 |
| 4,109,806 | 8/1978 | Johannson | 414/401 |
| 4,250,669 | 2/1981 | Freauf | 52/79.8 |

FOREIGN PATENT DOCUMENTS

| | | | |
|---|---|---|---|
| 1340677 | 9/1963 | France | 52/79.8 |

*Primary Examiner*—Henry E. Raduazo

[57] ABSTRACT

A permanent dwelling adapted to receive and functionally couple with a mobile home having at least kitchen and bathroom facilities. The permanent dwelling is characterized in being devoid of plumbing facilities, thereby resulting in a substantial decrease in the costs of building and upkeep. Configured as such, the dwelling may be left in severe weather conditions without drainage of pipes and the like and may be "reopened" without the commensurate problems of restarting the water supply thereto.

10 Claims, 5 Drawing Figures

DWELLING STRUCTURE

This application is a continuation-in-part of a pending U.S. application filed Sept. 22, 1978 entitled "Dwelling Structure", U.S. Ser. No. 944,788 now U.S. Pat. No. 4,250,669 by the applicant of the present invention.

BACKGROUND OF THE INVENTION

Both mobile homes and vacation homes have enjoyed an increase in popularity over the last ten to fifteen years. As might be expected, both types of homes have advantages as well as disadvantages. The mobile home provides a spontaneous mobility and is relatively inexpensive while the vacation home provides the owner with a relatively spacious and quietly removed retreat for vacations as well as intermittent weekends. The disadvantages of the mobile home involve the rather cramped general living quarters and the question of availability of space at campsites for such homes. The disadvantages of the normal vacation home involve principally cost of construction and maintenance. In this latter category, a disproportionately large amount is paid for plumbing, bathroom facilities and kitchen facilities. Approximately twenty-five to thirty-five percent of a home is dedicated to these necessities.

While the mobile home may be hitched to a vehicle and carted away at the owner's whim, the vacation home, especially in severe winter conditions when intermittently used, must have its pipes drained when it is not occupied or be subject to increased heating costs due to a necessity for keeping the heating on in order to prevent the freezing of the pipes contained therein. With heating costs having skyrocketed in the last few years, this option is available only to those few who can afford two heating bills. Consequently, most vacation homeowners with houses located in areas with freezing or subfreezing temperatures have opted for the drainage and restart program upon leaving and again arriving, respectively.

SUMMARY OF THE INVENTION

The present invention is addressed to a low-cost, easily maintainable alternative dwelling combination which incorporates the advantages of both the mobile home as well as the permanent dwelling. The permanent dwelling of the present invention is configured having the appearance of a normal permanent home with the added provision of a carport, either closed or not, to receive and functionally couple with a mobile home having at least a kitchen and bathroom. The conventional characteristics of the permanent dwelling permit its location wherever desirable by the owner. In fact, it is anticipated that one owner would locate one of such permanent dwelling structures in Northern climates for use during the summer months and another in Southern climates for use during the winter months and travel therebetween in his mobile home. The permanent dwelling structure is characterized in being devoid of any plumbing facilities thereby resulting in a substantial decrease in the costs of building such a home and keeping up such a home. The permanent dwelling structure includes a general living area which might include a living room and dining room, and a plurality of bedrooms. Additives such as porches, decks and patios may be added and included if desired by the owner.

The permanent dwelling structure also includes at least one door positioned proximate the desired location of the mobile home when the two are connected together. Other doors, windows and the like may be located wherever desired. The only other necessary addition to the permanent dwelling structure is the provision for a connection between the mobile house unit and the permanent dwelling structure for making a relatively airtight connection between the two when they are joined.

In one embodiment of the present invention, movable connection walls and a floor unit are provided for connecting the permanent housing structure with the mobile home in a relatively air-tight manner. The movable walls and floor unit provide a solid connection while at the same time allowing the mobile home to be placed next to the permanent structure in a relatively non-exacting manner. Additionally, roller units may be employed under the mobile home for facilitating the movement of the unit toward the permanent home when the former has been parked.

It is therefore a primary object of the present invention to provide a permanent dwelling structure which is adapted to receive and functionally couple with a mobile home having at least kitchen and bathroom facilities, the permanent dwelling structure being devoid of such facilities.

It is a general object and feature of the present invention to provide a permanent dwelling structure having a general living area and a sleeping area which is electrified but which is devoid of plumbing facilities so as to decrease the cost of construction of such a dwelling structure.

It is another general object and feature of the present invention to provide a permanent dwelling structure adapted to receive and functionally couple with a mobile home unit having at least a kitchen and bathroom, the mobile home unit being configured, in combination with the permanent dwelling structure, as an electrical switch between an externally located source of electricity and the permanent dwelling structure itself.

It is another object and feature of the present invention to provide an inexpensive permanent dwelling structure which may be duplicated in various locations and which is arrived at through the use of a mobile home which the permanent dwelling structure is adapted to receive, the combination of the permanent dwelling structure and the mobile home resulting in a conservation of energy costs of heating such permanent dwelling structure while the mobile home is absent therefrom.

It is yet another object and feature of the present invention to provide a permanent dwelling structure adapted to receive and functionally couple with a mobile home unit, the two units being connectable by expandable solid wall and floor units.

It is another object and feature of the present invention to provide a permanent dwelling structure adapted to receive and functionally couple with a mobile home unit, the mobile home unit being movable by a plurality of roller elements toward and away from the permanent structure thereby obviating the need for delicate and ultracareful parking of the mobile home unit next to the permanent structure.

Other objects and features of the present invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DETAILED DESCRIPTION OF THE INVENTION

Figure 1:
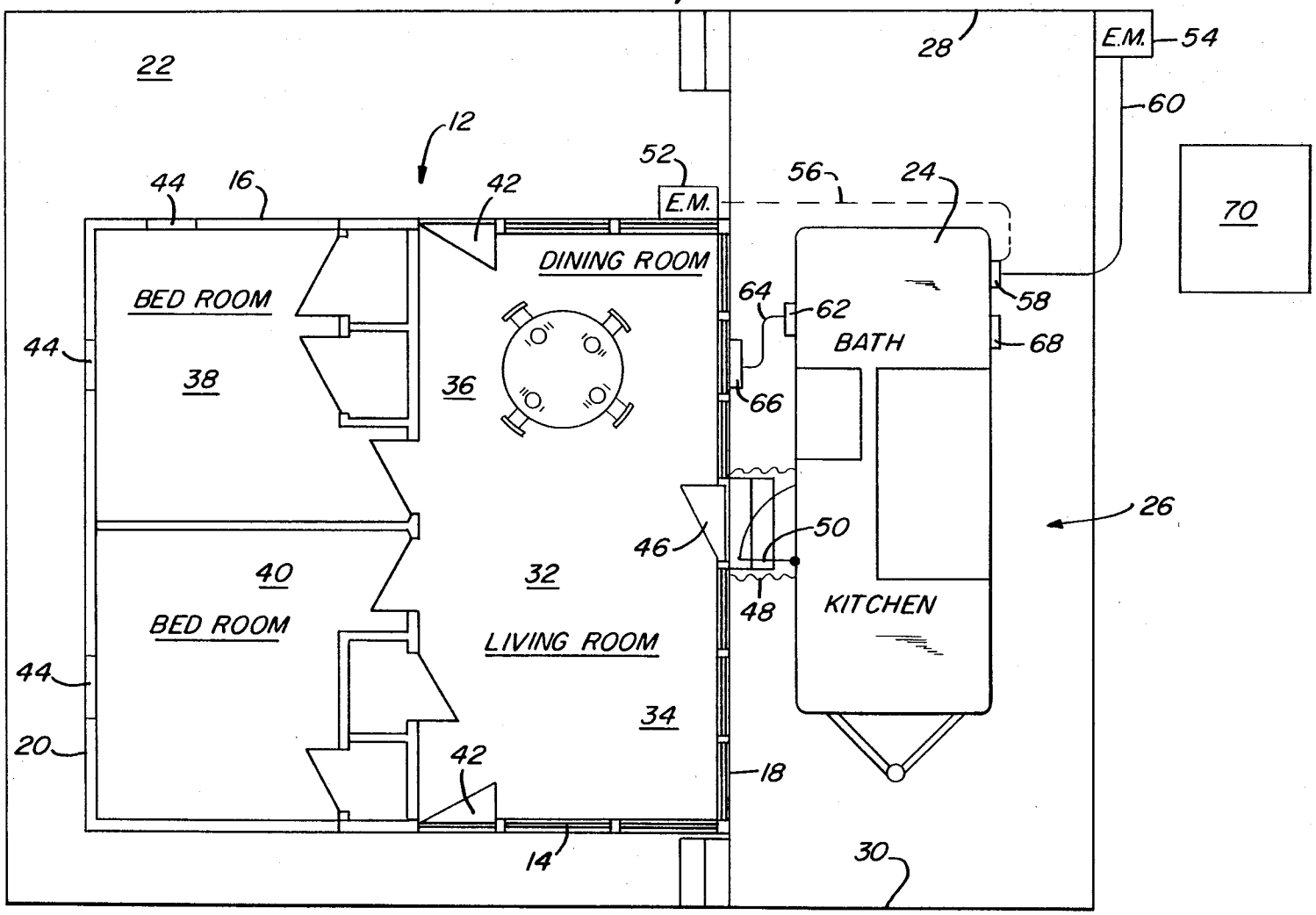
FIG. 1 is plan view of the permanent dwelling structure of the present invention with the mobile home unit shown in a position adjacent thereto.
Figure 2:
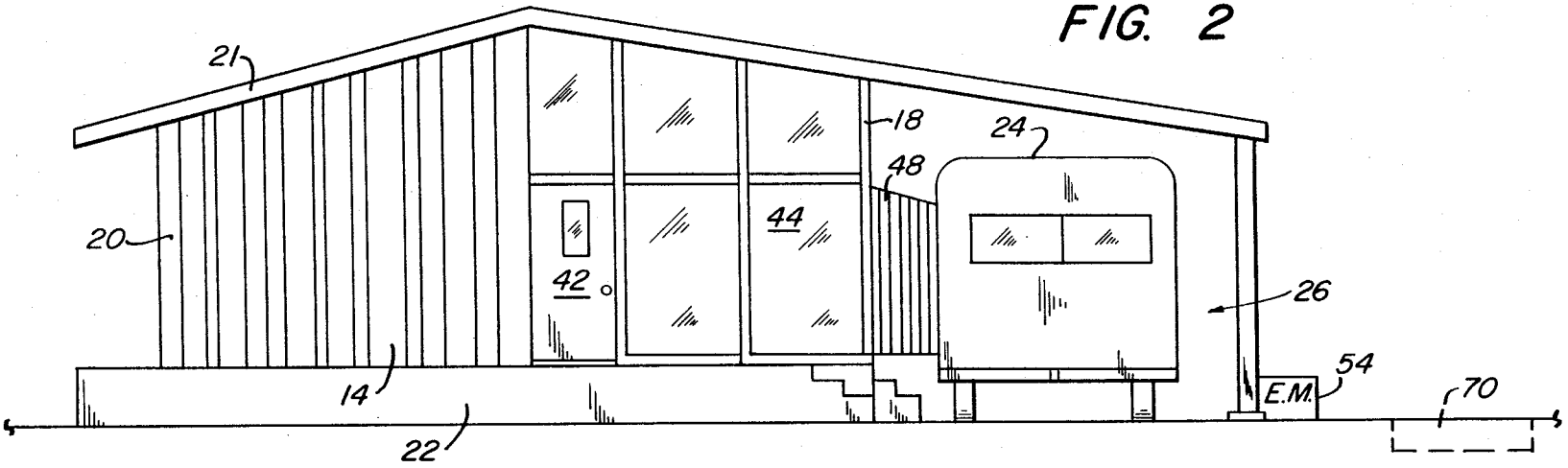
FIG. 2 is a side elevational view of the structure of FIG. 1 and the mobile home attached thereto.
Figure 3:
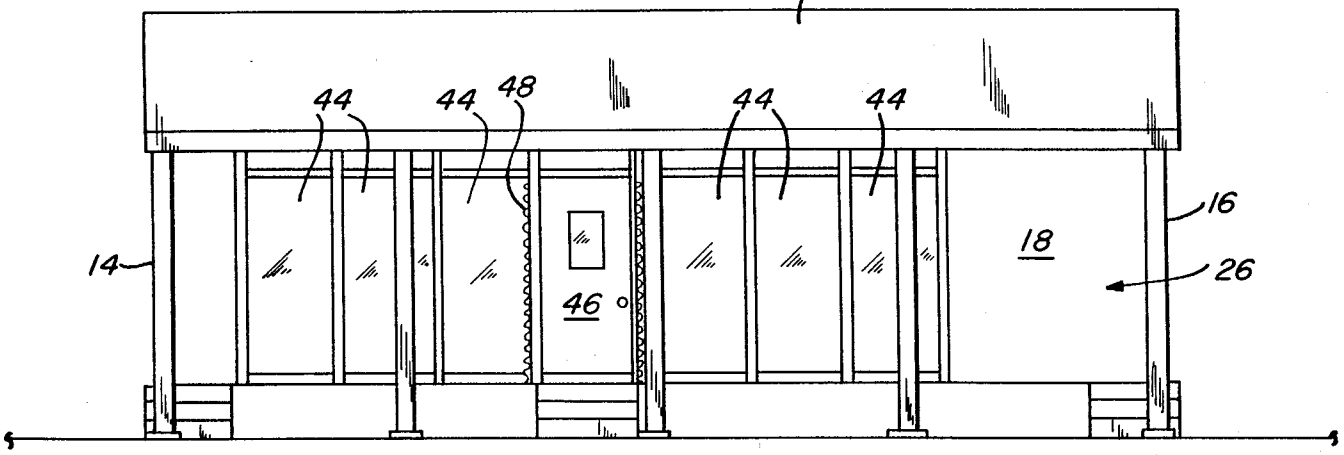
FIG. 3 is a front elevational view of the structure of FIG. 1 with the mobile home unit removed for purposes of clarity.

The permanent dwelling and mobile home structures of the present invention are shown generally at 10 in FIG. 1. The permanent home structure 12 is generally configured having a front wall 14, a rear wall 16, two side walls 18 and 20 and a roof 21. The permanent structure may be situated on a standard foundation resulting in a basement (not shown) or may be situated on a slab of concrete indicated at 22. It should be noted that the front, rear and side walls of the permanent structure 12 may be resituated so as to place the mobile home unit 24 at the side or rear of the permanent housing structure when the two are joined together. In some regions, the provision for the mobile home unit 24 may have to be made at the rear of the permanent housing structure in order to fall within zoning ordinances.

Positioned adjacent the permanent housing structure 12 itself is an area shown generally at 26 for the reception of a portable trailer housing unit 24. This area 26 may take the form of a carport as shown or may be totally enclosed with garage door structures (not shown) at points 28 and 30. Again, these alternative embodiments will be better understood when the particular zoning ordinances of a specific area are taken into account. Deck structures, patios and porches (all not shown) may be situated in any desired location about the permanent housing structure 12.

The permanent housing structure 12 itself may be of a one-story, two-story or multiple-story configuration. However, for purposes of clarity, the preferred embodiment of the present invention is shown as a one-story dwelling. The dwelling 12 includes a general living area 32 possibly including a living room area 34 and a dining room area 36 positioned proximate area 26 so as to communicate more efficaciously with the mobile housing unit 24 when the latter is attached to the permanent housing structure 12. Also included within the permanent housing structure 12 is a provision for sleeping quarters indicated at 38 and 40. Any number of doors and windows as at 42 and 44 respectively may be positioned about the exterior of the house at the personal taste of the owner.

The permanent housing structure 12, as may be noted from FIG. 1, is devoid of any plumbing facilities. The structure 12 includes all normal electrical facilities such as electrical heating units (not shown), outlets (not shown), air-conditioning units (not shown) and lights (not shown). The lack of plumbing facilities within the permanent housing structure 12 results in a much more inexpensive building cost for the structure 12 than that normally resulting when such a structure includes a kitchen and bathroom facility. It is conservatively estimated that the cost of bathroom and kitchen facilities involves between 25 and 35 percent of the cost of a normal permanent housing structure, the need for which is obviated by the provision of the same within the mobile housing structure 24. A primary portal 46 is positioned in a convenient location proximate the area 26 for providing ingress and egress from the dwelling to the mobile housing structure 24 for purposes of using the bathroom and kitchen facilities. Provision is made for a connection means 48 which is used to connect the permanent dwelling 12 to the mobile housing unit 24. The connection means 48 may be attached directly to the permanent housing structure 12 or to the mobile housing unit 24 and may take any one of a variety of accordion-like structures or balloon structures which would connect the permanent housing structure 12 to the mobile unit 24 in a relatively air-tight manner. Under the majority of circumstances, the portal 46 of the permanent housing structure 12 as well as the door 50 of the mobile housing unit 24 would remain in opened positions for the air-conditioning or heating of both units 12 and 24 at the same time. Accordingly, a practical and relatively air-tight connection structure 48 is a necessity for providing a connection between the two structures.

Figure 4:
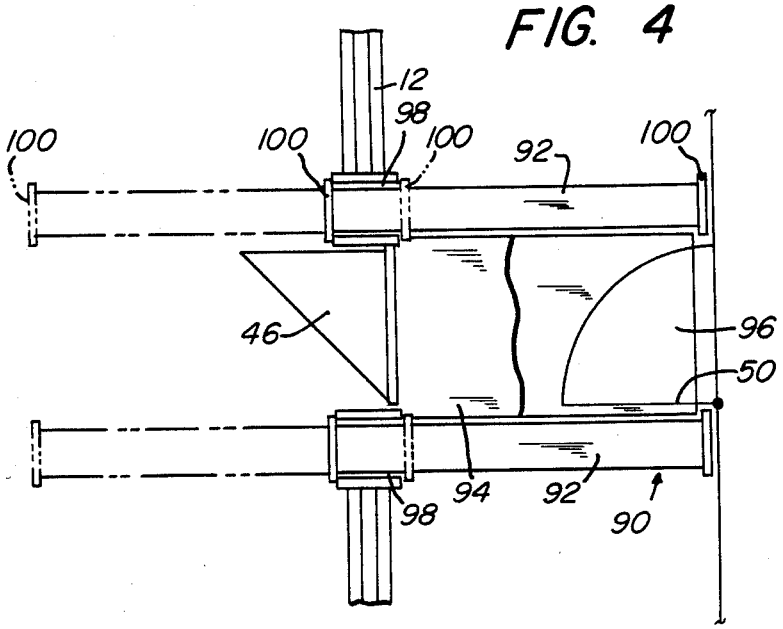
FIG. 4 is a portion of the plan view of the permanent dwelling structure of FIG. 1 with connection walls and a floor unit shown in both stored and operative locations.

Looking to FIG. 4, there is shown one preferred embodiment of a solid wall, floor and ceiling unit connection arrangement 90 between the permanent housing structure 12 and the mobile housing unit 24. Provided about the periphery of the permanent housing structure door 46 are two wall units 92, a floor unit 94, and a ceiling unit 96 (only a portion of which is shown for purposes of clarity). All units 92, 94 and 96 are configured having the same basic structural components and operation. Therefore, the following description of the wall units 92 is generic to the construction of the remaining units. Provided for sliding movement within a slotted apertures 98 in structure 12 are wall units 92. Wall units 92 when not in use are stored within the structure 12 as indicated in phantom in FIG. 4. However, when connection between the mobile unit is desired, wall units 92 (as well as the other ceiling and floor units) are pulled outwardly out from the structure 12 until they contact the mobile structure 24 as shown in solid lines in FIG. 4. The four units are then locked in place by any appropriate available elements such as bolts or the like. Located at each end of all four units 92, 94 and 96 are plates as at 100. The plates 100 are wider than the associated unit to which they are attached and therefore serve to limit both the inward and outward movement of the unit. Accordingly, the unit may not be pulled too far out or pushed too for in. The outward plates 100 also serve to increase the contact area between the unit in question and the mobile housing unit 24. All units 92, 94 and 96 are of any convenient length for connecting the structure 12 to the mobile unit 24 and are stored in this preferred embodiment inside structure 12 when not in use.

The incoming point for electricity to the permanent housing structure as well as the mobile home unit 24 may be made directly to the permanent housing structure as at 52 or the same may be positioned in a remote location from the housing structure as indicated at 54. Should the incoming point of electricity be located at 52, the permanent housing structure 12 would be electrified regardless of whether the mobile home unit 24 is present or not. Under such circumstances, an electrical line 56 may be provided for electrifying the mobile home unit through an input box 58 located on the mobile home unit 24. Should the source of electricity terminate exteriorly of the permanent housing structure 12 as at 54, an electrical line 60 would be provided between the electrical source 54 to the input point 58 on the mobile home unit 24. Provisions for electrifying the housing structure 12 would then be made through an output box 62 located on the mobile home unit 24 through an electrical line 64 to a terminus 66 located on the permanent housing structure 12. All electrical lines for the permanent housing structure 12 would then emanate from the box 66 in much the same manner as a conventional home. The provision for the incoming source of electricity at a location 54 provides an added advantage of safety in that the mobile home unit 24 would act as a switch for incoming electricity to the permanent housing structure 12. Thusly, the permanent housing structure 12 would be incapable of being electrified unless the mobile housing unit 24 were present. However, provisions may also be made for an electrical line (not shown) emanating directly from location 54 to the receptacle 66 should it be desired that the housing structure 12 be electrified in the absence of the mobile home unit 24.

Provisions for the elimination of waste from the mobile home unit 24 is conventionally made through an outlet 68 located on the mobile home unit 24. It is contemplated that a leaching field or holding tank shown generally at 70 may be provided proximate the permanent dwelling structure 12 for elimination of the accumulated wastes within the mobile housing unit 24. Due to the chemicals employed within mobile housing structures such as that indicated at 24, the owner of the dwelling 12 may only need a holding tank and not a leaching field. However, local zoning ordinaces would dicatate the particular nature of such waste disposal facilities.

Water to be supplied to the permanent housing structure 12 as well as the mobile home unit 24 may be provided through municipal sources, may be provided by the mobile housing structure 24 itself through its holding tanks (not shown) or may be provided through a well (not shown) located at a convenient and legal location about the permanent housing structure 12.

Figure 5:
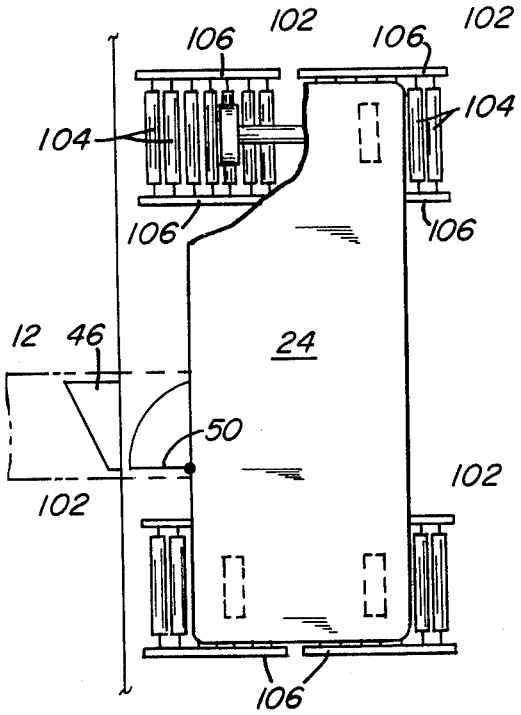
FIG. 5 is a plan view of one embodiment of the present invention indicating a plurality of roller units employed for moving a mobile home both toward and away from the permanent structure.

Looking to FIG. 5, there is shown a second arrangement for establishing connection between the permanent structure 12 and the mobile home 24. Provided within the floor of the carport area 26 are a series of four roller platforms 102. The roller platforms 102 are located and positioned such that the four tires of the mobile home will each fit on one platform when the doors of the permanent structure 12 and the mobile home are arranged in coincidence with one another for subsequent connection as shown in FIG. 5.

Each roller platform 102 is comprised of a plurality of individual rollers 104 mounted for rotation upon roller support elements 106 embedded in the floor of the carport area 26. When the mobile home 24 has been aligned with structure 12 such that doors 46 and 50 are parallel to one another, the mobile home 24 is moved a desired distance toward structure 12 upon the rollers 104. Movement may be effected by any appropriate method or elements such as hoists, jack arrangements or by motorization of the rollers themselves. When moved a proper distance such that the two structures are conveniently located from each other, the wall, ceiling and floor units described with respect to FIG. 4 are pulled out to make the proper connection between both structures 12 and 24. When the mobile home is to be removed the procedure is reversed.

It should be obvious that the particular arrangement of the permanent housing structure 12 and the mobile home 24 may be arranged for the personal tastes and/or zoning ordinances of the particular area in which the permanent dwelling 12 is located. Moreover, the specific arrangement of the living area 32 and the sleeping quarters contained within the permanent dwelling structure 12 as well as its architectural nuances may be adjusted according to the personal tastes and location of such a structure. The particular arrangement and architecture of such a structure while important, will not be discussed further herein. What is of primary importance, however, is the entire lack of plumbing facilities within the permanent structure 12 which results in several advantages. First, the lack of such facilities enables the homeowner to construct a dwelling without a major financial output. Second, the lack of plumbing facilities within the permanent structure 12 permits, in the case of a Northern latitude location for the structure 12, the homeowner to leave the structure 12 for an extended period of time without having to drain such plumbing facilities or, alternatively, heat the entire structure 12 in order to prevent the pipes, waterlines and general plumbing facilities from freezing in his absence. Configured as such, an owner may have a series of permanent housing structures 12 located in the desired locations he wishes which may be travelled to throughout the year. For example, an owner may have a permanent housing structure located in Northern climates for use during the summer months and a second structure located in Southern climates for use during winter months. This is especially practical for retirees who wish the best of both worlds. Such a retiree would live in the mobile home unit during his transport time between the two facilities and would hook-up to the respective permanent housing structure to enable him to live for a given period of time outside of the confining space limitations of the mobile home unit 24.

It should be apparent that the permanent housing structure 12 may be of a prefabricated design or may be built on site to the specifications of a general contractor or the owner himself. Major contractors may build a plurality of such structures in a desirable location with general public facilities such as lakes, beaches, bathhouses and general recreational facilities for use by a plurality of such dwelling structure owners. Such general recreational facilities may be owned directly by the homeowner himself or may be rented.

In conclusion, it should be realized that the combination of the permanent dwelling structure and the mobile home unit of the present invention provides a living system which includes the advantages of both the mobile home unit as well as a permanent housing structure. Applicant has attempted to point out the various and sundry additives to such a housing system. However, it should be noted that such additives have not been exhausted herewithin and may include any variety of combinations and permutations of facilities to the area in general as well as to the dwelling specifically. The present invention provides for an easily maintained permanent housing structure with relatively inexpensive building costs involved and greatly enhances the mobility, comfort, and security of the mobile home unit owner.

While certain changes may be made in the above-noted dwelling and dwelling combination without departing from the scope of the invention herein involved, it is intended that all matter contained in the above description or shown in the accompanyng drawings shall be interpreted as illustrative and not in a limiting sense.

I claim:

1. A dwelling adapted to releasably receive a portable towable trailer housing unit adjacent thereto, said dwelling being devoid of plumbing and utilizing the bathroom and kitchen facilties of such portable trailer housing unit when the two are joined together, said dwelling comprising:

a general living area;

a sleeping area;

portal means for permitting egress and ingress to the dwelling;

means, positioned proximate one of said portal means, for joining the portable trailer housing unit to said dwelling for making connection between the two when the two are joined; and means, stationarily mounted proximate said dwelling for engaging the tires of the portable trailer housing for facilitating the movement of the portable trailer toward and away from said dwelling.

2. The dwelling according to claim 1 wherein said dwelling includes electrical wiring therein, said electrical wiring emanating from a common outlet positioned on the exterior of said dwelling and a source of incoming electricity positioned outside said dwelling, said outlet and said source being connectable by suitable electrical wiring contained within such portable trailer, such portable trailer acting as an electrical safety switch between said outlet and said source.

3. The dwelling according to claim 1 wherein said means for facilitating movement is a plurality of roller means adaptable to movably support such portable trailer through its tires in a direction normal to such trailer's conventional movement while being towed.

4. The dwelling according to claim 1 wherein said means for joining the portable trailer with said dwelling is configured to expand out from said dwelling and is of solid wall construction.

5. A combination dwelling having two independent and joinable portions, said combination dwelling comprising:

a stationary portion, being devoid of any plumbing facilities; said stationary portion comprising:

a general living area;

sleeping area;

portal means for permitting ingress and egress to said stationary portion of said dwelling;

a self-contained and portable housing portion of the type having a sleeping area, a general living area, a kitchen and a bathroom, said portable housing portion being removably positionable adjacent one of said portal means for connecting the portable housing portion to the stationary housing portion such that the kitchen and bathroom facilities of said portable housing unit may be utilized along with the non-plumbed facilities of said stationary housing portion to form a full-facilitied housing unit when the stationary and portable portions are joined; and means, stationarily mounted proximate said dwelling, for facilitating the movement of such portable trailer toward and away from said dwelling by supportably engaging such portable trailer through its tires.

6. The dwelling according to claim 5 wherein said means for facilitating movement is a plurality of roller means adaptable to movably support such portable trailer through its tires.

7. The dwelling according to claim 5 wherein said means for joining the portable trailer with said dwelling is configured to expand out from said dwelling and is of solid wall construction.

8. A combination dwelling having two independent and joinable portions, said combination dwelling comprising:

a stationary portion, being devoid of any plumbing facilities; said stationary portion comprising:

a general living area;

sleeping area;

portal means for permitting ingress and egress to said stationary portion of said dwelling;

a self-contained and portable housing portion of the type having a sleeping area, a general living area, a kitchen and a bathroom, said portable housing portion being removably positionable adjacent one of said portal means for connecting the portable housing portion to the stationary housing portion such that the kitchen and bathroom facilities of said portable housing unit may be utilized along with the non-plumbed facilities of said stationary housing portion to form a full-facilitied housing unit when the stationary and portable portions are joined, said dwelling including electrical wiring therein, said electrical wiring emanating from a common outlet positioned on the exterior of said dwelling and a source of incoming electricity positioned outside said dwelling, said outlet and said source being connectable by suitable electrical wiring contained within such portable housing portion, such portable housing portion acting as an electrical safety switch between said outlet and said source; and means, stationarily mounted proximate said dwelling, for facilitating the movement of such portable trailer toward and away from said dwelling by supportably engaging such portable trailer through its tires.

9. A housing arrangement comprising:

a plurality of stationary housing units being devoid of any plumbing facilities; each of said stationary units comprising:

a general living area;

a sleeping area;

portal means for permitting ingress and egress to said stationary housing units;

a self-contained and portable housing portion of the variety including a sleeping area; a general living area; a kitchen and a bathroom, said portable housing unit being removably positionable adjacent one of said portal means for connecting said portable housing unit to a stationary housing unit such that the kitchen and bathroom facilities of said portable housing unit may be combined along with the non-plumbed facilities of each of said stationary housing units to form a full-facilitied housing unit when the stationary and portable housing units are joined; and means, formed as a portion of said stationary housing units, for facilitating movement of such portable trailer toward and away from each stationary housing units by supportably engaging said portable housing portion through its tires.

10. The dwelling according to claim 9 wherein said dwelling includes electrical wiring therein, said electrical wiring emanating from a common outlet positioned on the exterior of said dwelling and a source of incoming electricity positioned outside said dwelling, said outlet and said source being connectable by suitable electrical wiring contained within such portable trailer, such portable trailer acting as an electrical safety switch between said outlet and said source.

* * * * *